US010591862B1

(12) United States Patent
Able et al.

(10) Patent No.: US 10,591,862 B1
(45) Date of Patent: Mar. 17, 2020

(54) REDUCING IMAGING DEVICE CHURN BY MANAGING UNPRODUCTIVE PHOTOCONDUCTIVE DRUM REVOLUTIONS

(71) Applicant: Lexmark International, Inc., Lexington, KY (US)

(72) Inventors: Douglas Anthony Able, Shelbyville, KY (US); Kevin Dean Schoedinger, Lexington, KY (US)

(73) Assignee: LEXMARK INTERNATIONAL, INC, Lexington, KY (US)

( * ) Notice: Subject to any disclaimer, the term of this patent is extended or adjusted under 35 U.S.C. 154(b) by 0 days.

(21) Appl. No.: 16/248,192

(22) Filed: Jan. 15, 2019

(51) Int. Cl.
*G03G 15/00* (2006.01)
*B41J 29/38* (2006.01)

(52) U.S. Cl.
CPC ..... *G03G 15/5095* (2013.01); *B41J 29/38* (2013.01)

(58) Field of Classification Search
CPC ..... G03G 15/5008; G03G 15/505
USPC ..... 399/36, 75, 76, 167
See application file for complete search history.

*Primary Examiner* — William J Royer

(57) ABSTRACT

An imaging system having methods for reducing churn in an imaging device which includes identifying a number of unproductive revolutions made in a print engine of the imaging device, determining whether the number of unproductive revolutions exceeds a predetermined threshold, and performing at least one of: using a predetermined speed limit when printing a page and disabling a function in the imaging device upon the determination that the number of unproductive revolutions exceeds the predetermined threshold.

20 Claims, 5 Drawing Sheets

REDUCING IMAGING DEVICE CHURN BY MANAGING UNPRODUCTIVE PHOTOCONDUCTIVE DRUM REVOLUTIONS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.
None.

BACKGROUND

1. Technical Field

The present disclosure relates generally to reducing imaging device churn and, more particularly, to reducing churn in the imaging device by managing unproductive engine revolutions.

2. Description of the Related Art

Imaging devices typically change print process speeds every time media sheets are switched from one type (e.g., quality of media, size of media) to another. In one example scenario, a print speed of the imaging device may vary depending upon a media configuration of the print job. A print job having a first media type may be processed at a slower rate than a print job having another media type. For example, a print engine of the imaging device may run at a speed of 63-70 pages per minute (ppm) when printing jobs requiring plain paper and at a speed of about 55 ppm when printing jobs requiring special paper (e.g., labels). In another example scenario, pages of a multiple-page print job may be configured to be printed on different media sheet types. As such, when processing the multiple-page print job, the imaging device may switch between different print speeds.

In both scenarios where print speeds are changed depending upon the media configurations of the print jobs, components of the print engine may incur more revolutions than intended. Extra revolutions in the print engine are undesirable as these may consume the life of the imaging device and its consumables faster without contributing to any operation in the imaging device. Besides processing print jobs of different media configurations, extra or unproductive revolutions may also be caused when print job data is received beyond the expected time (e.g., slow network connections), when the generation of the print data is slower than the print engine throughput (e.g., slow image generation), or when duplex or two-sided printing is performed.

Unproductive revolutions cause excess churn in the imaging device. Imaging devices typically manage churn by controlling the process speed in the imaging device. Functions are often added in the imaging device to control the time when the print engine may be revved up to process the print job, to prevent the print engine from starting up when no print data is available, and the like. However, having these functions may reduce the performance of the imaging device such that print jobs may be processed slower compared to when no restrictions to avoid churn are set in place.

SUMMARY

An imaging system having methods for reducing churn in an imaging device are disclosed. One example method for reducing churn in an imaging device may include determining whether a print setting of a page for printing differs from a print setting of a previously printed page and, upon a positive determination: identifying a number of unproductive revolutions made by a print engine of the imaging device while transitioning the imaging device to a print-ready mode, determining whether the number of unproductive revolutions exceeds a predetermined threshold, and using a predetermined speed limit when printing the page upon the determination that the number of unproductive revolutions exceeds the predetermined threshold.

Another example method for reducing churn in an imaging device may include determining whether a function in the imaging device is enabled and, upon a positive determination: identifying a number of unproductive revolutions made by the print engine while transitioning the imaging device to a print-ready mode, determining whether the number of unproductive revolutions has reached a predetermined threshold, and disabling the function in the imaging device upon the determination that the number of unproductive revolutions has reached the predetermined threshold. The enabled function in the imaging device may be a function for reducing a time to first print of the imaging device and/or a function for increasing a print productivity of the imaging device.

Additional features and advantages of various example embodiments will be better understood in view of the detailed description provided below.

BRIEF DESCRIPTION OF THE DRAWINGS

The above-mentioned and other features and advantages of the present disclosure, and the manner of attaining them, will become more apparent and will be better understood by reference to the following description of example embodiments taken in conjunction with the accompanying drawings. Like reference numerals are used to indicate the same element throughout the specification.

DETAILED DESCRIPTION OF THE DRAWINGS

Figure 1:
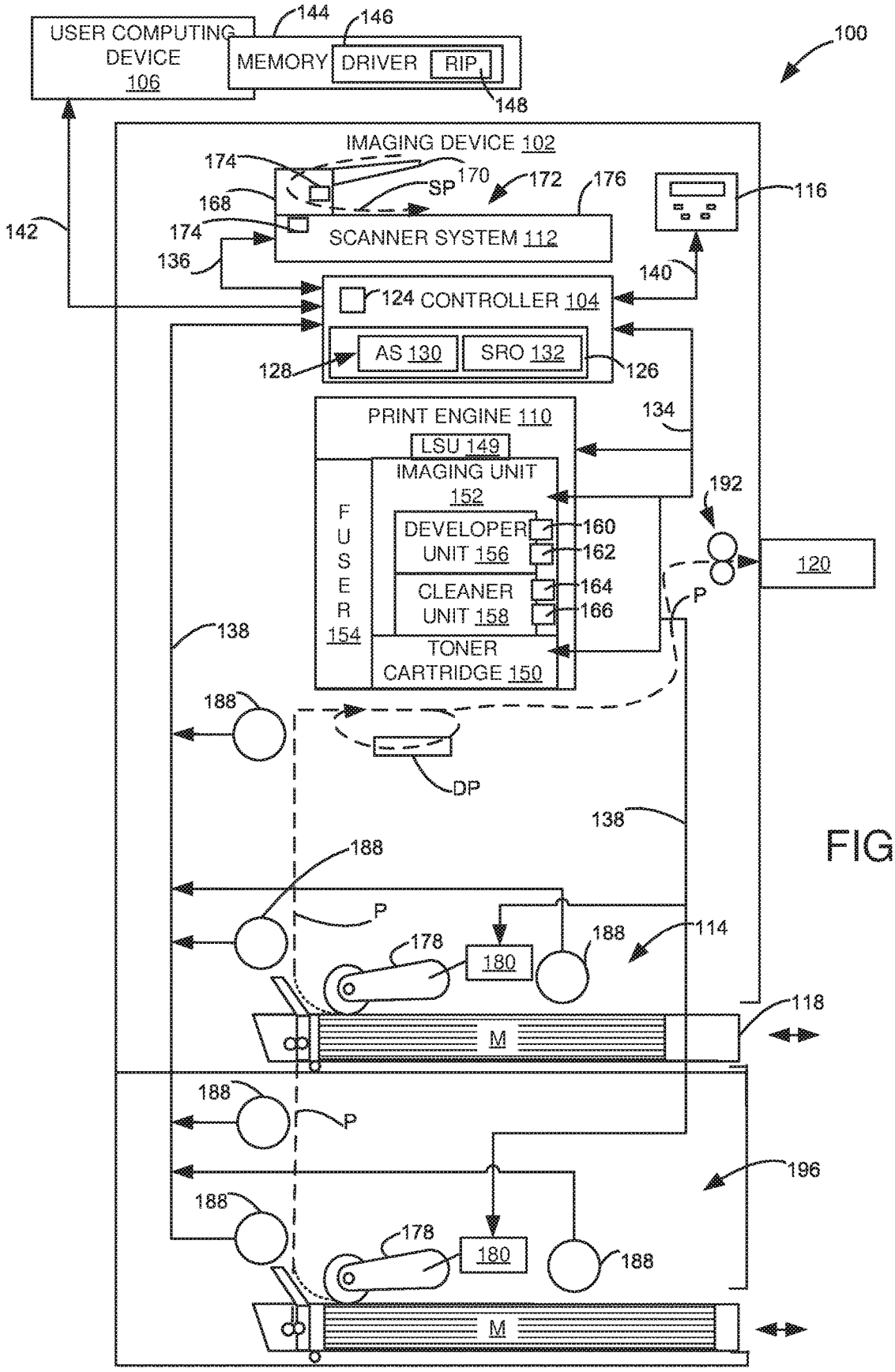
FIG. 1 is a diagrammatic depiction of an example imaging system which includes an example imaging device having a controller and a user computing device communicatively connected to the imaging device, according to one example embodiment.

It is to be understood that the disclosure is not limited to the details of construction and the arrangement of components set forth in the following description or illustrated in the drawings. The disclosure is capable of other example embodiments and of being practiced or of being carried out in various ways. For example, other example embodiments may incorporate structural, chronological, process, and other changes. Examples merely typify possible variations. Individual components and functions are optional unless explicitly required, and the sequence of operations may vary. Portions and features of some example embodiments may be included in or substituted for those of others. The scope of the disclosure encompasses the appended claims and all available equivalents. The following description is, therefore, not to be taken in a limited sense, and the scope of the present disclosure is defined by the appended claims.

Also, it is to be understood that the phraseology and terminology used herein is for the purpose of description and should not be regarded as limiting. The use herein of "including," "comprising," or "having" and variations thereof is meant to encompass the items listed thereafter and equivalents thereof as well as additional items. Further, the use of the terms "a" and "an" herein do not denote a limitation of quantity but rather denote the presence of at least one of the referenced item.

In addition, it should be understood that example embodiments of the disclosure include both hardware and electronic components or modules that, for purposes of discussion, may be illustrated and described as if the majority of the components were implemented solely in hardware.

It will be further understood that each block of the diagrams, and combinations of blocks in the diagrams, respectively, may be implemented by computer program instructions. These computer program instructions may be loaded onto a general-purpose computer, special purpose computer, or other programmable data processing apparatus to produce a machine, such that the instructions which execute on the computer or other programmable data processing apparatus may create means for implementing the functionality of each block or combinations of blocks in the diagrams discussed in detail in the description below.

These computer program instructions may also be stored in a non-transitory computer-readable medium that may direct a computer or other programmable data processing apparatus to function in a particular manner, such that the instructions stored in the computer-readable medium may produce an article of manufacture, including an instruction means that implements the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions specified in the block or blocks.

Accordingly, blocks of the diagrams support combinations of means for performing the specified functions, combinations of steps for performing the specified functions and program instruction means for performing the specified functions. It will also be understood that each block of the diagrams, and combinations of blocks in the diagrams, may be implemented by special purpose hardware-based computer systems that perform the specified functions or steps or combinations of special purpose hardware and computer instructions.

FIG. 1 is a diagrammatic depiction of an example imaging system 100 which includes an imaging device 102 having a controller 104 and a user computing device 106 communicatively connected to imaging device 102, according to one example embodiment. In the present disclosure, controller 104 may track revolutions made by components in imaging device 102 and determine whether these revolutions are unproductive and exceed a predetermined count or threshold. If so, controller 104 may then adjust settings in imaging device 102. The unproductive revolutions may be incurred, for example, while waiting for a print command to be received in imaging device 102, while processing pages of a print job, or while waiting for a new print job, as will be discussed in the figures that follow.

Imaging device 102 is shown as a multifunction machine or an all-in-one (AIO) unit that includes controller 104, a print engine 110, a scanner system 112, a media feed system 114 and a user interface 116. Imaging device 102 may direct a media sheet from a removable media input tray (RMIT) 118 to at least one output destination 120. Imaging device 102 may further include a finisher (not shown) for performing a finishing operation (e.g., stapling, hole-punch, etc.) on a printed media sheet prior to directing the media sheet to output destination 120. While imaging device 102 is shown as a multifunction machine, imaging device 102 may also be configured to be a single function printer and may not have scanner system 112. Imaging device 102 may be communicatively connected to other imaging devices or to other computing devices (not shown). In other example embodiments, imaging device 102 may operate in a standalone mode. In the standalone mode, imaging device 102 may function without user computing device 106. While imaging device 102 is illustrated as being an electrophotographic printer, those skilled in the art will recognize that imaging device 102 may be, for example, an ink jet printer, a thermal transfer printer, or another type of printer.

Controller 104 may include a processor unit 124 and an associated memory 126. Controller 104 may be formed as one or more Application Specific Integrated Circuits (ASICs). Processor unit 124 may process instructions stored in memory 126 as well as instructions received from other components connected to imaging device 102 or components installed in imaging device 102. In one example embodiment, memory 126 may be a volatile or a non-volatile memory or a combination of both installed in imaging device 102. Memory 126 may be, for example, random access memory (RAM), read only memory (ROM), flash memory and/or non-volatile RAM (NVRAM). In another example embodiment, memory 126 may be a separate electronic memory (e.g., RAM, ROM, and/or NVRAM), a hard drive, a CD or DVD drive, or any storage device convenient for use with controller 104. Memory 126 may include firmware modules 128 used for controlling operations in imaging device 102 and components which are connected to or installed in imaging device 102. In the present disclosure, firmware modules 128 may include an Advanced Start (AS) function 130 and a Smart Run-Out (SRO) function 132. AS function 130 and SRO function 132 may help improve a print performance of imaging device 102. When enabled, AS function 130 may help reduce a time to first print in imaging device 102. When enabled, SRO function 132 may help increase a productivity of imaging device 102.

In FIG. 1, controller 104 is illustrated as being communicatively coupled to print engine 110 via a communication link 134, to scanner system 112 via a communication link 136, to media feed system 114 via a communication link 138, to user interface 116 via a communication link 140 and to user computing device 106 via a communication link 142. Communication links 134, 136, 138, 140, and 142 may be standard communication protocols such as, for example, universal serial bus (USB), Ethernet, or other communication protocols specified in IEEE 802.xx standards.

Instructions for controlling print engine 110, scanner system 112, user interface 116, and media feed system 114 may be stored in memory 126. Controller 104 may control print engine 110, scanner system 112, user interface 116, and media feed system 114 by referring to instructions stored in memory 126. Controller 104 may be, for example, a combined printer and/or scanner controller. In one example embodiment, controller 104 may include instructions to process an electronic document from user computing device 106 and to operate print engine 110 when printing the electronic document. In other example embodiments, controller 104 may include instructions to operate scanner system 112 to allow scanning of a physical document and to process data obtained during scanning to user computing device 106 or for printing. Controller 104 may notify computing user device 106 and/or user interface 116 regarding a condition of imaging device 102 or any of the replaceable consumables installed in imaging device 102 (e.g., toner cartridge 150, imaging unit 152, etc.), and media sheets being processed by imaging device 102.

User computing device 106 may be a mobile computing device connected to imaging device 102. User computing device 106 may be, for example, a smartphone, a laptop, a tablet, a smartwatch, and the like. User computing device 106 may be wired to imaging device 102 or may be located remotely and connected to imaging device 102 via a network. User computing device 106 may include a memory 144 having an imaging driver (driver) 146. User computing device 106 may store in memory 144 a document (not shown) for printing by imaging device 102. Imaging driver 146 may be a software program for facilitating communications between imaging device 102 and user computing device 106.

One aspect of imaging driver 146 may be, for example, to provide an electronic document to imaging device 102 in a format acceptable for printing by imaging device 102. Another aspect of imaging driver 146 may be, for example, to facilitate collection of scanned data from scanner system 112. In one example embodiment, imaging driver 146 may include a raster image processor (RIP) 148 which generates print data (i.e., a raster image) for each page of the document prior to or while sending the document to imaging device 102. In another example embodiment, firmware modules 128 of imaging device 102 may include RIP 148, so imaging device 102 may generate print data for each page of the document received from use computing device 106. In other example embodiments, a user of imaging device 102 may utilize user interface 116 to retrieve a document in a printable format from a remote storage location, such as memory 144 of user computing device 106, for printing by imaging device 102.

Print engine 110 may include a laser scan unit (LSU) 149, a toner cartridge 150, an imaging unit 152, and a fuser 154. LSU 149, toner cartridge 150, imaging unit 152, and/or fuser 154 may be removably mounted within imaging device 102. Imaging unit 152 and toner cartridge 150 may be supported in their respective operating positions in imaging device 102 so that toner cartridge 150 is operatively mated to imaging unit 152. Imaging unit 152 may include a developer unit 156 and a cleaner unit 158. Developer unit 156 may house a toner sump 160 and a toner delivery system 162. Toner delivery system 162 may include a toner adder roll 153 (see FIG. 2) that provides toner from toner sump 160 to developer unit 156. Cleaner unit 158 houses a photoconductive (PC) drum 164 and a waste toner removal system 166. Toner cartridge 150 communicates with developer unit 156 when periodically transferring toner from toner cartridge 150 to resupply toner sump 160 in developer unit 156. At least one of LSU 149, toner cartridge 150, imaging unit 152, and/or fuser 154 may be replaceable units in imaging device 102. Toner cartridge 150 and imaging unit 152 may each include a memory (not shown) for providing information to controller 104, such as a firmware version, capacity or rated life, pages printed, etc.

Scanner system 112 may include an automatic document feeder (ADF) 168 having a media input tray 170 and a media output area 172. Two scan bars 174 may be provided—one in ADF 168 and the other along a base 176—to allow for scanning both surfaces of a media sheet as it is fed from media input tray 170 along scan path SP to media output area 172. Scanner system 112 may employ any scanning technology known in the art at the time of the filing of this application.

Media feed system 114 may include a pick mechanism 178 for picking each media sheet in the stack and a drive mechanism 180 for driving pick mechanism 178. Pick mechanism 178 may be mechanically coupled to drive mechanism 180. Drive mechanism 180 may be controlled by controller 104 via communication link 138. During operation, pick mechanism 178 may drive a topmost media sheet from media stack M in RMIT 118 and direct the picked media sheet to a media path P which extends from RMIT 118 to output destination 120 via print engine 110. Bottom feed media trays may also be used in alternative example embodiments. In other example embodiments, media feed system 114 may include a multipurpose media input tray (not shown). The multipurpose media input tray may be detachable from a housing of imaging device 102 or may be incorporated into RMIT 118 for holding media sheets other than the ones stored in RMIT 118.

Media feed system 114 may further include at least one media sensor 188. At least one media sensor 188 may also be controlled by controller 104 via communication link 138. Each media sensor 188 may be used to detect a presence of a media sheet in RMIT 118 or an optional additional RMIT 196 in imaging device 102, to determine a type of the media sheet in the input tray, to detect a position or location of the media sheet as it travels along media path P, and/or to determine the size of the media sheet. Additional media sensors may be installed throughout media path P (and a duplex portion DP of the media path P, when provided), and their positioning in imaging device 102 may be a matter of design choice.

Media feed system 114 may further include an exit feed roll pair 192 to deliver the printed media sheet from print engine 110 to output destination 120. Exit feed roll pair 192 may be rotated in a first direction to direct the media sheet to output destination 120 and in a second direction to direct the media sheet back in imaging device 102 to duplex portion DP for duplex printing. Output destination 120 may be, for example, a standard bin, a mailbox bin, or another bin type in imaging device 102. Output destination 120 may be a bin removably attached to imaging device 102.

User interface 116 may receive input from a user of imaging device 102. For purposes of the present disclosure, user interface 116 may refer to a combination of hardware and software in imaging device 102. In one example embodiment, user interface 116 may include an alphanumeric keypad and a display screen for generating displays associated with user inputs made on the alphanumeric keypad. In another example embodiment, user interface 116 may include a touch-operated display screen which generates an alphanumeric keypad display. Inputs received by user interface 116 may be sent to controller 104. Controller 104 may then determine whether the user input translates to, for example, a file input, a text input, a print command, or another type of instruction from the user.

RMIT 118 may be used to contain a plurality of media sheets for printing in imaging device 102. In one example embodiment, the media sheets in RMIT 118 may be of the same media type. In another example embodiment, RMIT 118 may be used to contain media sheets of different media types.

Output destination 120 may be used to store media sheets from RMIT 118. While one output destination 120 is illustrated in FIG. 1, there may be a plurality of output destinations in imaging device 102. In one example embodiment, a number of output destinations 120 may correspond to a number of input trays in imaging device 102. For example, one output destination 120 may be used to contain media sheets from RMIT 118, and another output destination 120 may be used to contain media sheets from RMIT 196. In other example embodiments, each output destination 120 may be associated with a type of printing. For example, a first output destination 120 may be used to contain media sheets with printed text while a second output destination 120 may be used to contain media sheets with printed images.

Firmware modules 128 may include AS function 130 and SRO function 132. When enabled, AS function 130 and SRO function 132 may help improve a print performance of imaging device 102. While AS function 130 and SRO function 132 are illustrated as stored in memory 126 of imaging device 102, AS function 130 and SRO function 132 may be stored in another storage medium communicatively connected to controller 104 of imaging device 102.

AS function 130 may include instructions for powering print engine 110 upon receipt of a print job in imaging device 102. In one example embodiment, controller 104 may send a command to print engine 110 to transition to print-ready mode. The command may be sent as the images for each page of the print job are being received from RIP 148. When enabled, AS function 130 helps improve the print performance of imaging device 102 by lessening an amount of time it takes to first print (TTFP) in imaging device 102. SRO function 132 may include instructions for continuing to supply power to print engine 110 while another print job is present. In example embodiments where RIP 148 is in imaging device 102, controller 104 may include instructions to request for a state of RIP 148 and, upon a determination that RIP 148 is still busy generating images associated with a new print job, to prevent print engine 110 from turning off. When enabled, SRO function 132 helps improve the print performance of imaging device 102 by increasing a productivity of print engine 110.

RMIT 196 may be removably attached to a bottom portion of imaging device 102. RMIT 196 may be the same as RMIT 118. Pick mechanism 178, drive mechanism 180, and at least one media sensor 188 may be built inside RMIT 196. Drive mechanism 180 and at least one media sensor 188 in RMIT 196 may be connected to controller 104 via communication link 138. In one example embodiment, RMIT 118 and RMIT 196 may store media sheets of different media types (e.g., letter, legal, A4, etc.). For example, RMIT 118 of may be used to store letter-sized media sheets while RMIT 196 may be used to store legal-sized media sheets.

Figure 2:
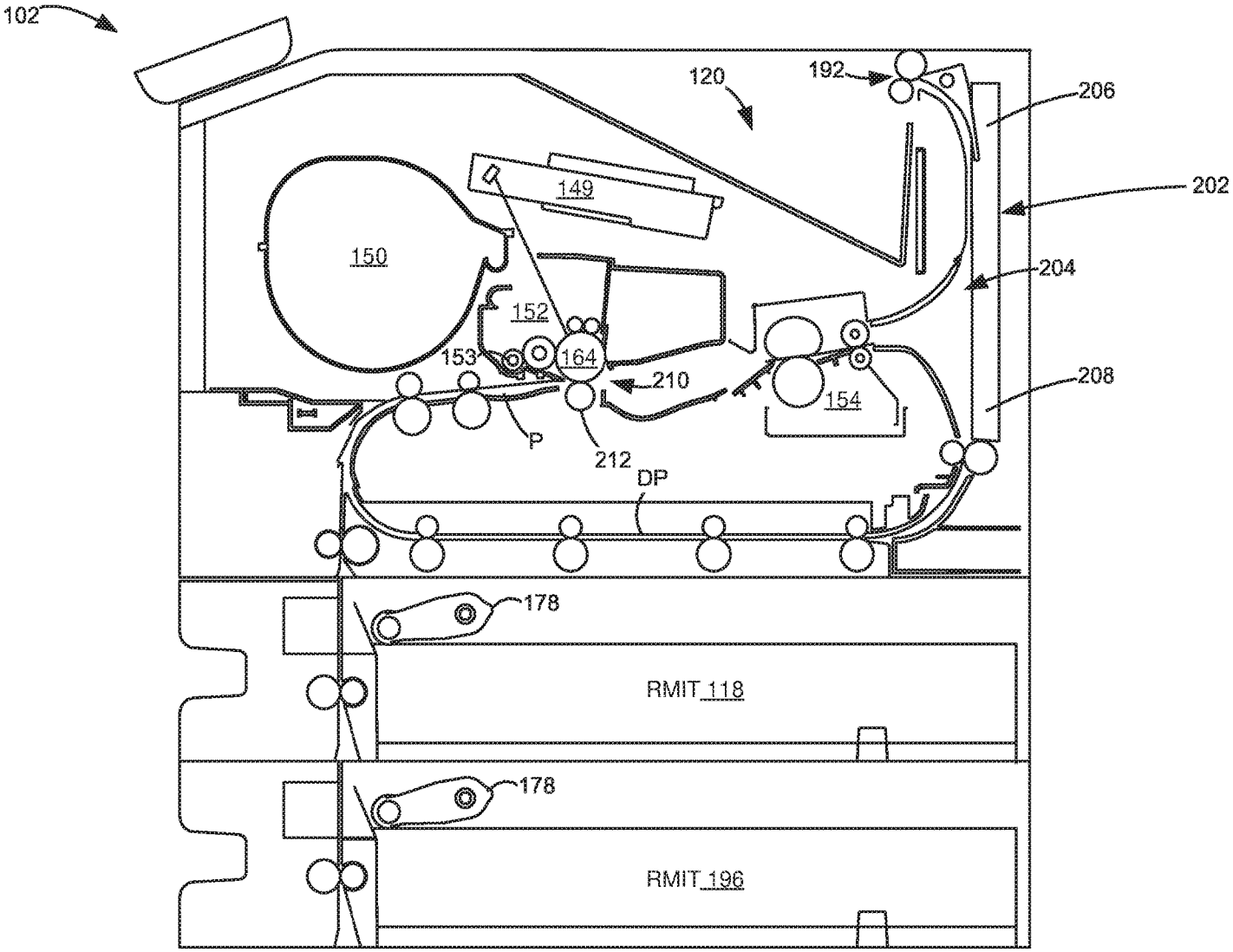
FIG. 2 is an example side cross-section of the imaging device in FIG. 1.

FIG. 2 is an example side cross-sectional view of imaging device 102 of FIG. 1. The electrophotographic imaging process is well known in the art and will be briefly described with reference to FIG. 2. In FIG. 2, imaging device 102 is shown to include an access door 202, allowing users to access internal components of imaging device 102. Access door 202 may include a media path channel 204 extending from an upper portion 206 adjacent output destination 120 to a bottom portion 208 thereof. When closed, as shown in FIG. 2, access door 202 may complete media path P in imaging device 102. When open, access door 202 may allow access to the interior of imaging device 102. With access door 202 in the open position, LSU 149, toner cartridge 150, imaging unit 152, and/or fuser 154 may be removed from imaging device 102. As shown in FIG. 2, as a media sheet is moved from RMIT 118 or RMIT 196 to at least one output destination 120, media path P has an inverted S-shape.

During the electrophotographic printing process, LSU 149 may direct a laser beam on a charged surface of PC drum 164 in imaging unit 152 to create a latent image. Toner cartridge 150 may supply toner onto the charged surface of PC drum 164. A toned image corresponding to the latent image may then be formed on PC drum 164. The toned image may then be transferred from PC drum 164 to a media sheet picked from RMIT 118 or RMIT 196 at a transfer nip 210 formed between PC drum 164 and backup roll 212 and through which the media sheet passes. The media sheet may then move to fuser 154 where the toned image is fused onto the media sheet by application of heat and/or pressure.

A simplex portion of media path P may extend from RMIT 118 or RMIT 196 through imaging unit 152, fuser 154, and exit feed roll pair 192 positioned adjacent output destination 120. A duplex portion (DP) of media path P may include an entrance adjacent bottom portion 208 of access door 202 and an exit merging with a beginning portion of the simplex portion. Exit feed roll pair 192 may be rotated in a first direction when directing the fused media sheet to output destination 120 and in a second direction opposite the first direction when directing the fused media sheet to the duplex portion DP of the media path P. For a simplex or single-sided printing operation, exit feed roll pair 192 may direct the fused media sheet to output destination 120. For duplex or double-sided printing operation, exit feed roll pair 192 may direct the fused media sheet back into imaging device 102 through media path channel 204 to the duplex portion DP of the media path P.

AS function 130 and SRO function 132 may be enabled in imaging device 102 by default to improve the print performance of imaging device 102. If AS function 130 is enabled, The PC drum 164 continues rotating when it is determined by controller 104 that a print job is received in imaging device 102 or that a print job is being transmitted to imaging device 102. PC drum 164 continue rotating until the last page of the print job. If SRO function 132 is enabled, PC drum 164 may continue rotating for a predetermined period to wait for a new print job to be received. However, keeping PC drum 164 rotating and, therefore, all the other components of print engine 110 running while no printing is performed may be unproductive in imaging device 102.

Figure 3:
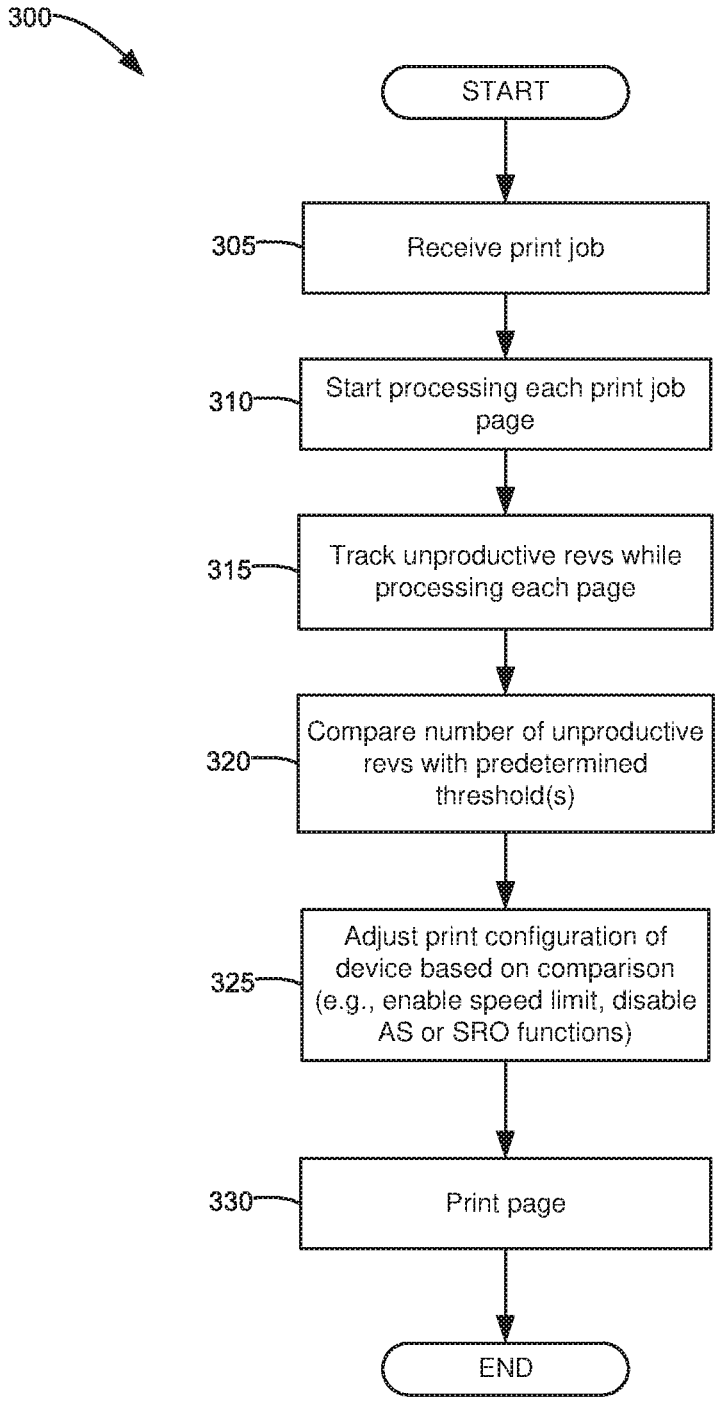
FIG. 3 is a flowchart showing one example method for managing churn in an imaging device, such as the imaging device in FIG. 1.

FIG. 3 is a flowchart showing one example method 300 for managing churn in an imaging device, such as imaging device 102 of FIG. 1. Example method 300 may be performed by controller 104 of imaging device 102. Instructions for controller 104 to perform example method 300 may be stored in memory 126. Example method 300 may start following a power on reset (POR) of imaging device 102 or while imaging device 102 is waiting for user input (e.g., standby or idle mode).

At block 305, controller 104 may receive a print job. The print job may be received from user computing device 106. In one example embodiment, controller 104 may receive images from user computing device 106 associated with each page of the print job and generated by RIP 148. Controller 104 may store the images received in memory 126 or on another storage medium for imaging device 102.

The images may be stored in memory 126 while waiting for instructions to print the print job at imaging device 102. The images may be deleted once sent for printing to print engine 110. In another example embodiment, imaging device 102 may automatically convert the received print job to a format acceptable for printing upon receipt of the print job.

Controller 104 may determine the print settings of the print job received. The print settings may include a resolution of the print job, the one or more media types for the pages of the print job, a color preference, and/or the like. Controller 104 may determine the print settings while receiving the print job or after receiving the print job from user computing device 106. The print settings may be in the form of a metadata attached to the print job when sent to imaging device 102. In one example embodiment, imaging device 102 may be in a print-ready mode when receiving the print job at block 305. In another example embodiment, controller 104 may command print engine 110 to transition to a print-ready mode when the print job is received.

At block 310, controller 104 may start processing each page of the print job received at block 305. Processing each page may include identifying a print setting for the print job page, determining whether the print job page is the last page for printing, and comparing the print setting of each print job page with a print setting of the previous page printed. In one example embodiment, controller 104 may determine whether AS function 130 is enabled in imaging device 102 prior processing each page. In another example embodiment, controller 104 may determine whether SRO function 132 is enabled in imaging device 102 while processing each page. How each page of the print job may be processed will be discussed in greater detail below in connection with FIGS. 4A and 4B. In other example embodiments, controller 104 may start processing each page following receipt of a print command from a user of imaging device 102.

At block 315, controller 104 may track unproductive revolutions while processing each page of the print job. In one example embodiment, controller 104 may determine a number of unproductive revolutions incurred while waiting for media feed system 114 to be ready to pick a media sheet for printing and following a determination that AS function 130 is enabled in imaging device 102 (AS unproductive revolutions). In another example embodiment, controller 104 may determine a number of unproductive revolutions incurred when imaging device 102 is transitioning to a print-ready mode upon a determination that a resolution or a print process speed of the page for printing is different from a resolution or a print process speed of the previously printed page (RS unproductive revolutions). In yet another example embodiment, controller 104 may determine a number of unproductive revolutions incurred while waiting for images associated with the received print job to be available and following a determination that SRO function 132 is enabled in imaging device 102 (SRO unproductive revolutions).

At block 320, controller 104 may compare the number of unproductive revolutions with a predetermined threshold. In one example embodiment, the predetermined threshold may differ based upon a type of unproductive revolution. For example, a first predetermined threshold, a second predetermined threshold, and a third predetermined threshold may be set for AS unproductive revolutions, for SRO unproductive revolutions and for RS unproductive revolutions, respectively. In other example embodiments, the predetermined threshold may be the same for at least two types. For example, the predetermined threshold may be the same for AS unproductive revolutions and SRO unproductive revolutions but different for RS unproductive revolutions.

At block 325, controller 104 may then adjust a default print configuration of imaging device 102 based upon the comparison of the number of unproductive revolutions to the predetermined threshold. Adjusting a print configuration of imaging device 102 may include enabling a print process speed limit in imaging device 102, disabling at least one of AS function 130 and SRO function 132 in imaging device 102, or combination of both, as will be discussed in connection with FIGS. 4A-4B below. Controller 104 may maintain the current print configuration of imaging device 102 when the number of unproductive revolutions falls within the predetermined threshold. Thus, the action at block 325 may be optional.

At block 330, controller 104 may then instruct print engine 110 to print the page following adjustments to the print configuration of imaging device 102. In printing the page, a media sheet may be picked from RMIT 118 or RMIT 196, depending upon a media type identified for printing the page. The picked media sheet may then be directed to print engine 110 for transferring a toned image corresponding to the print job page. Blocks 310-330 may be repeated until the last page of the print job is printed.

Figure 4A:
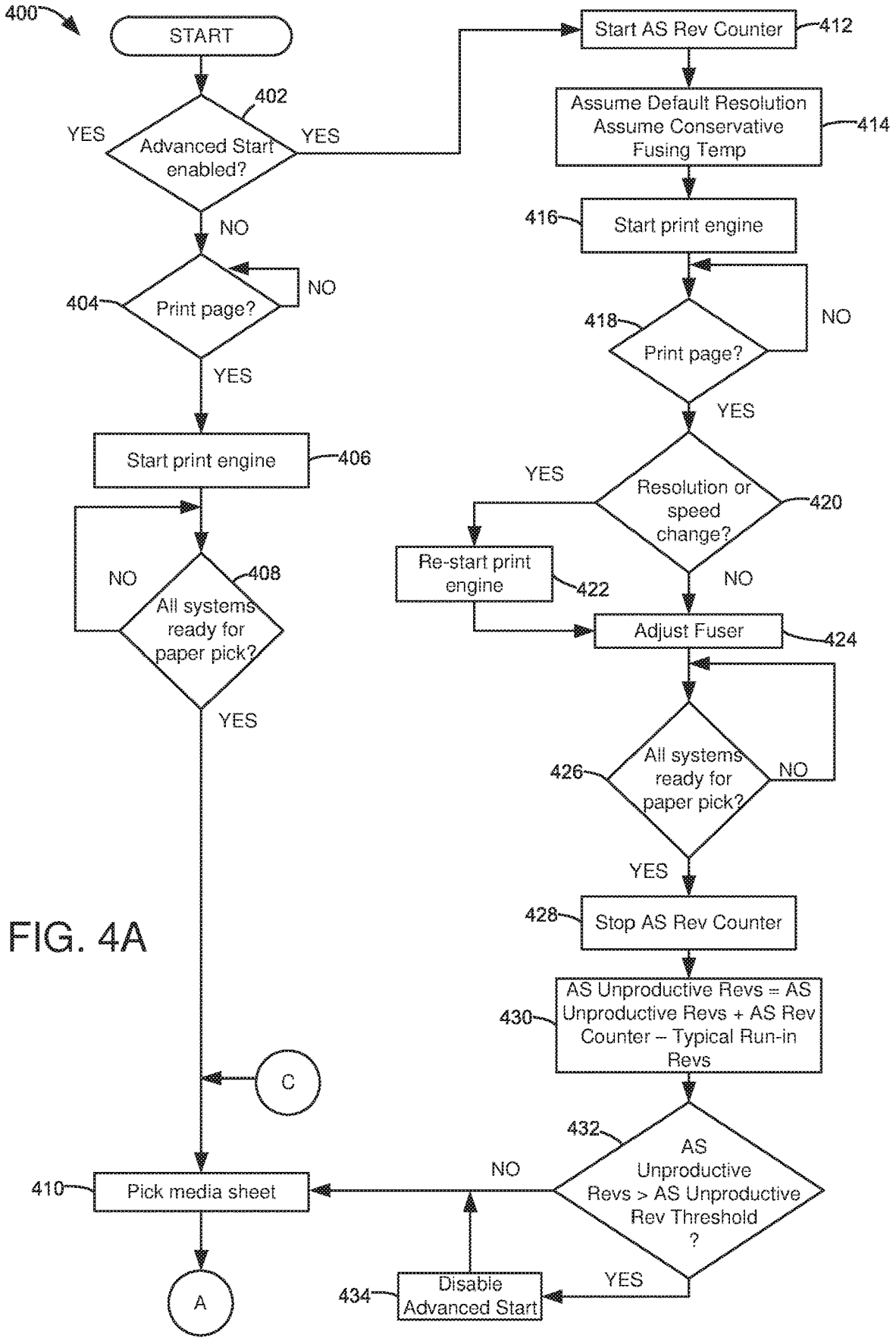
FIGS. 4A and 4B are flowcharts showing one example method for processing a print job in an imaging device based on the example method in FIG. 3.
Figure 4B:
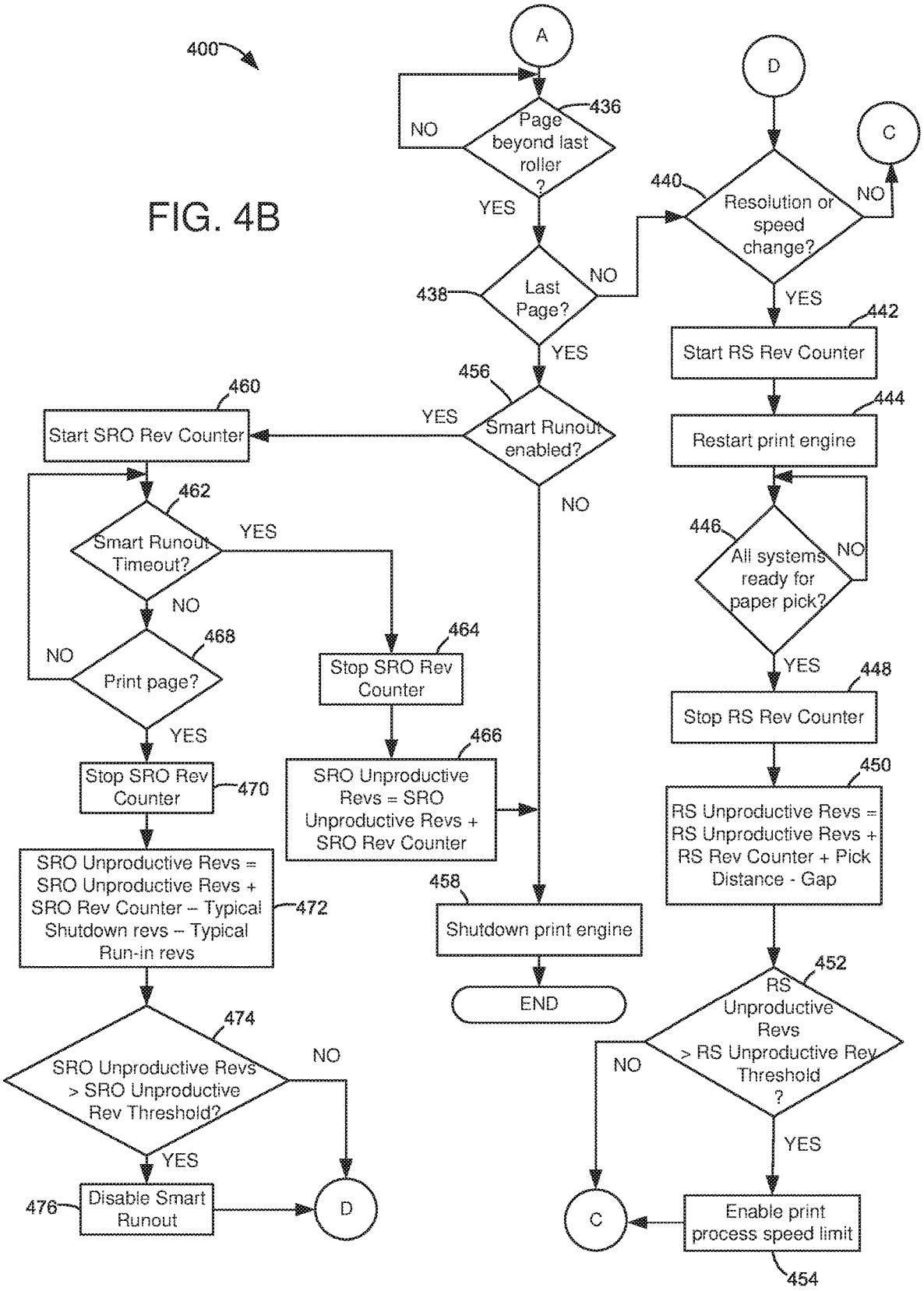

FIGS. 4A and 4B are flowcharts showing one example method 400 for processing a print job in imaging device 102 based upon example method 300 of FIG. 3. Example method 400 may be performed by controller 104. FIG. 4A includes blocks 402-434 while FIG. 4B includes blocks 436-476. While shown as separate figures, blocks 402-476 may altogether be referred to as example method 400.

FIG. 4A includes actions taken when tracking unproductive revolutions while AS function 130 is enabled. With reference to FIG. 4A, at block 402, controller 104 may determine whether AS function 130 is enabled in imaging device 102. In the present disclosure, example method 400 may start following receipt of a print job or while a print job is being received in imaging device 102 from, for example, user computing device 106. In other example embodiments, where AS function 130 is not physically stored in memory 126 of imaging device 102, controller 104 may determine whether imaging device 102 includes instructions to power up print engine 110 when a print job is received or while a print job is being received by imaging device 102.

At block 404, upon a determination that AS function 130 is disabled, controller 104 may determine whether to print a page at imaging device 102. In one example embodiment, controller 104 may determine whether a print command is received by imaging device 102. Controller 104 may continue to wait for the print command and place the printing of a page on hold until the print command is received. In another example embodiment, controller 104 may determine whether a page of the print job is ready or available for printing. In this example embodiment, controller 104 may determine whether images associated with the print job are available in memory 126 of imaging device 102 for printing.

At block 406, controller 104 may start or bring print engine 110 to a print-ready mode state following a determination at block 404 that the page is to be printed. Controller 104 may determine the print settings of the received print job and may adjust a print configuration of imaging device 102 to suit the print settings of the print job. In one example embodiment, starting print engine 110 may include starting at least one of LSU 148, imaging unit 152, fuser 154, and toner cartridge 150. It is to be understood that, in some example aspects, selected portions of print engine 110 may be started but not the whole print engine 110.

At block 408, controller 104 may then determine whether imaging device 102 is ready to perform printing. Controller 104 may continue to determine whether imaging device 102 is ready to perform printing until controller 104 determines that print engine 110 is ready to print. At block 410, upon a determination that imaging device 102 is in the print-ready mode, controller 104 may instruct media feed system 114 to pick a media sheet page for printing. A media sheet may be picked from either RMIT 118 or RMIT 196 depending upon the media type set for printing the print job page.

With reference back to block 402, at block 412, upon a determination that AS function 130 is enabled in imaging device 102, controller 104 may start a count of a number of revolutions made by PC drum 164 until a media sheet is ready to be picked for printing a print job page. For purposes of the present disclosure, this count of the number of revolutions may be referred to as an AS revolution counter. In one example embodiment, the counter may start from a time that controller 104 has identified that AS function 130 is enabled in imaging device 102 until a time that imaging device 102 is in a print-ready mode. In some example aspects the counter may continue counting until media feed system 114 is ready to pick up a media sheet for printing.

With AS function 130 enabled in imaging device 102, controller 104 may command print engine 110 to transition to a printing state even when no print command is received for a print job. In powering print engine 110 while waiting for a print command, PC drum 164 may be rotated in imaging device 102 even when no printing operation is performed, which is unproductive in imaging device 102. To control unproductive revolutions, controller 104 may track the number of revolutions made by PC drum 164 and determine whether the number of revolutions is the same as the number of revolutions made when AS function 130 is disabled in imaging device 102.

At block 414, controller 104 may assume at least one of a default resolution and a conservative fusing temperature in printing the pages of the print job. In one example embodiment, assuming the default resolution in printing the pages of the print job may include generating an image for each print job page using the default resolution. In another example embodiment where an image is already generated for each page of the print job, assuming the default resolution may include converting a resolution of each generated image to the default resolution. Assuming the conservative fusing temperature in printing the pages of the print job may include heating fuser 154 to the conservative fusing temperature. The conservative fusing temperature may be the lowest heating temperature that fuser 154 may operate at. The conservative fusing temperature may be the fusing temperature used for a predetermined media type in imaging device 102 which may not need a high temperature for fusing. For purposes of the present disclosure, the conservative fusing temperature may be used to allow fuser 154 to reduce the amount of time spent waiting for fuser 154 to transition from a cool, non-fusing temperature to the fusing temperature or vice-versa. The default resolution and/or the conservative fusing temperature may be predetermined in imaging device 102. The default resolution and/or the conservative fusing temperature may be stored in memory 126.

At block 416, controller 104 may start print engine 110. Starting print engine 110 may include heating fuser 154 to the conservative fusing temperature and adjusting RIP 148 enabling RIP 148 to generate images associated with the print job in the default resolution. In some example aspects, controller 104 may start one or more selected portions of print engine 110. For example, fuser 154 may be instructed to heat to the conservative fusing temperature in starting print engine 110 and other components of print engine 110 (i.e., LSU 149, developer unit 156 and cleaner unit 158 of imaging unit 152, toner cartridge 150) may be left unaffected.

At block 418, similar to block 406, controller 104 may determine whether to print a page. In one example embodiment, controller 104 may determine whether a print command is received in imaging device 102. Controller 104 may continue to wait for the print command and place the printing of the page on hold until the print command is received. In another example embodiment, controller 104 may determine whether a page of the print job is ready or available for printing. In this example embodiment, controller 104 may determine whether an image associated with the print job is available in memory 126 for printing.

At block 420, controller 104 may determine for each page whether there is a need to change a resolution or a print process speed in imaging device 102. Controller 104 may determine the resolution or the print process speed of the print job page based upon the print settings of the print job. Controller 104 may then determine whether there is a need to change the resolution or the print process speed based upon a comparison between the print settings of the current print job page and the default print configuration of imaging device 102. In other example embodiments, the comparison may be made between the print settings of the current print job page and the print settings of the prior print job page printed.

At block 422, upon a determination that there is a need to change a resolution or a print process speed in imaging device 102, controller 104 may restart print engine 110. Restarting print engine 110 may include adjusting fuser 154 or other parts of print engine 110 to adapt to the resolution or the print process speed change. At block 424, upon a determination that there is no need to change the resolution or the print process speed or following the restarting of print engine 110, controller 104 may adjust fuser 154 to the conservative fusing temperature so that the toned image may be completely fused onto the media sheet.

At block 426, following adjustment of fuser 154, controller 104 may then determine whether imaging device 102 is ready to perform printing, similar to block 408 in FIG. 4A. Controller 104 may continue to perform the determination until print engine 110 is ready to print the page. At block 428, following adjustment of fuser 154 so imaging device 102 is ready to print, controller 104 may stop the count of the number of revolutions made by PC drum 164 following a determination that AS function 130 is enabled until a time that imaging device 102 is in a print-ready mode or when media feed system 114 is ready to pick up a media sheet for printing (AS revolution counter).

At block 430, controller 104 may then determine a total number of unproductive revolutions incurred following a determination that AS function 130 is enabled in imaging device 102 and while waiting for media feed system 114 to be ready to pick a media sheet for printing (AS unproductive revolutions). The unproductive revolutions may be calculated using a difference between an actual number of revolutions made while waiting for the media sheet page to be picked from a corresponding media input tray and a number of revolutions that would have accumulated if AS function 130 is disabled in imaging device 102. In one example embodiment, the total number of unproductive revolutions may be based on a stored count of the number of unproductive revolutions in imaging device 102 (AS unproductive revolutions), the number of AS revolutions (AS revolution counter) and the typical number of run-in revolutions. The number of unproductive revolutions may be initialized during a first time that AS unproductive revolutions have been tracked and may be maintained in memory 126 for updating. The typical run-in revolutions may refer to an average number of revolutions that are incurred between starting print engine 110 and being ready for picking a page, i.e., the revolutions incurred between blocks 416 and 426 in FIG. 4A. The typical run-in revolutions may be stored in memory 126.

At block 432, controller 104 may determine whether the total number of unproductive revolutions determined at block 430 is greater than a predetermined threshold (AS unproductive revolutions threshold) for a number of unproductive revolutions following a determination that AS function 130 is enabled and while waiting for media feed system 114 to be ready to pick up a media sheet for printing. Upon a determination that the total number of unproductive revolutions determined at block 474 does not exceed the predetermined threshold, example method 400 may proceed to block 410 and instruct media feed system 114 to pick a media sheet for printing an image corresponding to the page received at the start of example method 300. Otherwise, at block 434, controller 104 may disable AS function 130 upon a determination that the total number of unproductive revolutions determined at block 474 exceeds the predetermined threshold. Following block 434, example method 400 may also proceed to block 410 where controller 104 instructs media feed system 114 to pick a media sheet for printing. Following block 410, controller 104 may proceed to FIG. 4B to process succeeding pages of a print job.

FIG. 4B includes blocks 436-476. In FIG. 4B, subsequent pages of the print job may be processed. Unproductive revolutions that are incurred while processing each page of the print job or while processing each print job may be tracked. The number of unproductive revolutions may then be compared to corresponding thresholds in imaging device 102 to determine whether to adjust one or more settings in imaging device 102.

At block 436, controller 104 may determine whether a printed page passed a preidentified roller along the media path. In one example embodiment, the preidentified roller may correspond to the last feed roller that the printed media sheet moves through prior to being disposed onto output destination 120, such as exit feed roll pair 192. In another example embodiment, the preidentified roller may correspond to a roll in fuser 154. At least one media sensor 188 may be disposed adjacent to the preidentified roller to determine whether the printed page passed through the preidentified roller. Determining whether the printed page passed through the preidentified roller may allow controller 104 to determine whether the current page has progressed enough so that controller 104 may start determining whether to shut print engine 110 down.

At block 438, following a determination that the page being printed passed the preidentified roller, controller 104 may determine whether the page processed in FIG. 4A is the last page to be printed. In one example embodiment, controller 104 may determine whether a page for printing is queued in memory 126. In another example embodiment, controller 104 may determine whether a new print job is being processed in RIP 148.

At block 440, following a determination that the page being processed is not the last page, controller 104 may determine whether there is a need to change a resolution or a print process speed of imaging device 102. Controller 104 may retrieve an image corresponding to the next page from RIP 148 upon a determination that the page printed at block 402 is not the last page. Controller 104 may determine the resolution or the print process speed required for the next print page based upon its corresponding print settings. The print settings for the next page may be the print settings of the print job to which it is associated. Controller 104 may then compare whether there is a need to change based upon a comparison between the print settings for the next print page and the print settings of the previously printed page. Upon a determination that there is no need to change to another resolution or to change the print process speed of imaging device 102, controller 104 may proceed to block 410 in FIG. 4A to instruct media feed system 114 to pick a media sheet for printing the next page using the default print configuration of imaging device 102.

At block 442, controller 104 may start to count the number of revolutions made by PC drum 164 when transitioning print engine 110 to the resolution or the print process speed identified at block 440. For purposes of the present disclosure, this number of revolutions may be referred to as a resolution switch (RS) revolution counter. In one example embodiment, the counter may start from the time that controller 104 identifies that a resolution or a print process speed change is needed for printing the next print page and continue until imaging device 102 is in a print-ready mode or until media feed system 114 is ready to pick a media sheet for printing.

At block 444, following the start of the RS revolution counter, controller 104 may restart print engine 110 to adapt to the change in the resolution or the print process speed for processing the next page. Other components of imaging device 102, such as media feed system 114, may also be restarted. In another example embodiment, controller 104 may adjust a print configuration of imaging device 102 to suit the print settings of the next page to be processed.

At block 446, controller 104 may determine whether imaging device 102 is ready to perform printing. For purposes of the present disclosure, imaging device 102 is ready to perform printing when components in imaging device 102 are ready to pick a media sheet from RMIT 118 or RMIT 196. Controller 104 may continue the determination until imaging device 102 is ready to perform printing. Imaging device 102 may be in a print-ready mode when media feed system 114 is ready to pick a media sheet and/or when print engine 110 is ready to print the image.

At block 448, following the transition of imaging device 102 to a print-ready mode, controller 104 may stop the counting the number of revolutions made by PC drum 164 during the transition (RS revolution counter). At block 450, controller 104 may determine the total number of unproductive revolutions incurred while switching imaging device 102 to a print-ready mode (RS unproductive revolutions). The number of unproductive revolutions incurred during a switch in resolution or a change in print process speed may be calculated as the difference between the actual number of revolutions made while waiting for the media sheet page to be picked on a corresponding media input tray (e.g., RMIT 118 or RMIT 196) and the number of revolutions that would have accumulated if no resolution switches or print process speed changes are made while processing each page. In one example embodiment, the total number of unproductive revolutions may be based on a stored count of the number of unproductive revolutions in imaging device 102 (RS unproductive revolutions), the number of RS revolutions (RS revolution counter), the pick distance, and the gap.

The pick distance may refer to an average distance from an origin input tray, such as RMIT 118 or RMIT 196, depending on which input tray the media type associated with the next page is stored to output destination 120 or to the preidentified last roller of block 436. The gap may refer to an average distance between media sheets as they move along the media path. The pick distance and the gap values may be known to imaging device 102 and may be stored in memory 126 or at another storage medium (e.g., remote server) connected to imaging device 102. The pick distance and the gap values may vary based upon the architecture of the media path in imaging device 102. Controller 104 may determine whether the number of unproductive revolutions is stored in memory 126 prior to updating the count of the number of revolutions. The stored count may be from a previous instance where the resolution or the process speed changed in imaging device 102. When no count of RS unproductive revolutions is stored, controller 104 may initialize the count (e.g., zero).

At block 452, controller 104 may determine whether the total number of revolutions determined at block 450 (RS unproductive revolutions) is greater than a predetermined threshold (RS unproductive revolutions threshold). Upon a determination that the total number of RS unproductive revolutions does not exceed the predetermined threshold, controller 104 may instruct media feed system 114 to pick a media sheet for printing an image corresponding to the page being processed (block 410 in FIG. 4A).

At block 454, controller 104 may enable a process speed limit in imaging device 102 upon a determination that the total number of revolutions determined at block 450 exceeds the predetermined threshold. Controller 104 may then instruct media feed system 114 to pick a media sheet for printing an image corresponding to the page being processed (block 410 in FIG. 4A) following block 454.

In one example embodiment, controller 104 may set the process speed limit in imaging device 102 to the lowest predetermined print process speed in imaging device 102. For example, controller 104 may determine that imaging device 102 may print on plain paper at about 70 pages per minute (ppm) using RMIT 118 and may print labels at about 55 ppm using RMIT 196. Based upon these predetermined print process speeds, controller 104 may set the common print process speed to at least about 55 ppm. In another example embodiment, controller 104 may set the process speed limit to an average of the process speeds in imaging device 102. Controller 104 may then use the process speed limit in processing successive print pages. In setting the process speed limit, significant process speed changes between print jobs or between pages of the same print job may be avoided.

With reference back to block 438, following a determination by controller 104 that the page being processed is the last page, controller 104 may determine whether SRO function 132 is enabled in imaging device 102 at block 456. At block 458, controller 104 may shut down print engine 110 upon a determination that SRO function 132 is disabled in imaging device 102. In one example embodiment, controller 104 may cut off the power provided to one or more components of print engine 110. In another example embodiment, controller 104 may decrease the power provided to one or more components of print engine 110 so that print engine 110 may not be able to perform a printing operation. Imaging device 102 may still be able to detect or receive print jobs. In yet other example embodiments, controller 104 may put print engine 110 on standby until a new print job is received by imaging device 102 instead of shutting down print engine 110. Following a determination that SRO function 132 is disabled in imaging device 102 and the shutting down of print engine 110, controller 104 may proceed to performing the actions shown in FIG. 4A.

If, at block 456, controller 104 determines that SRO function 132 is enabled in imaging device 102, controller 104 may start counting the number of revolutions made by PC drum 164 while waiting for an image associated with the next print page at block 460. For purposes of the present disclosure, this count of the number of revolutions may be referred to as an SRO revolution counter. In one example embodiment, the counter may start from the time that controller 104 identifies or detects that SRO function 132 is enabled in imaging device 102 to the time when imaging device 102 is in a print-ready mode or when media feed system 114 is ready to pick a media sheet for printing. At block 462, controller 104 may determine whether the time limit for shutting down print engine 110 has been reached. In one example embodiment, the time limit may be set when SRO function 132 is enabled in imaging device 102. The time limit may be preset in imaging device 102 to allow time to wait for new print jobs and prevent cutting off power to print engine 110.

At block 464, upon a determination that a predetermined timeout for SRO function 132 has been reached, controller 104 may stop counting the number of revolutions made by PC drum 164 which started at block 460 (SRO revolution counter). At block 466, controller 104 may then update a count of the number of unproductive revolutions made by PC drum 164 when SRO function 132 is enabled, based on the current SRO revolution counter. Controller 104 may determine whether a count of the number of unproductive revolutions (made by PC drum 164 when SRO function 132 is enabled) is stored in memory 126. The stored count may be from a previous instance that controller 104 determined that SRO function 132 is enabled in imaging device 102. When no count of unproductive revolutions is stored, controller 104 may initialize the count (e.g., zero). Following the updating of the count of the number of revolutions (SRO unproductive revolutions), controller 104 may then shut down print engine 110 (block 458).

Upon a determination that the predetermined timeout for SRO function 132 has not been reached (block 462), controller 104 may determine whether to print a page in imaging device 102 at block 468. In one example embodiment, controller 104 may determine whether a print command is received in imaging device 102. In another example embodiment, controller 104 may determine whether a page of the print job is ready or available for printing following a determination that SRO function 130 is enabled in imaging device 102. In this example embodiment, controller 104 may determine whether an image associated with the print job is available in memory 126 for printing. Upon a determination that a page is not ready for printing by imaging device 102, controller 104 may continue to determine whether to print a page until the predetermined timeout for SRO function 132 has been reached.

At block 470, following a determination by controller 104 to print the page, controller 104 may cease counting the number of revolutions made by PC drum 164 following a determination that SRO function 132 is enabled in imaging device 102 and while waiting for a print command (SRO revolution counter).

At block 472, controller 104 may determine the total number of unproductive revolutions incurred (SRO unproductive revolutions). The number of unproductive revolutions due to SRO function 132 being enabled may be calculated based upon the difference between the actual number of revolutions made while waiting for the media sheet page to be picked from a corresponding media input tray and a number of revolutions that would have accumulated if SRO function 132 is disabled in imaging device 102. In one example embodiment, the total number of unproductive revolutions may be based upon the stored count of the number of unproductive revolutions in imaging device 102 (SRO unproductive revolutions), the number of SRO revolutions (SRO revolution counter), a typical number of shutdown revolutions and a typical number of run-in revolutions.

The typical shutdown revolutions may refer to an average number of revolutions made in print engine 110 when shutting down from a print-ready mode. The typical run-in revolutions may refer to an average number of revolutions that are incurred between starting print engine 110 and being ready for picking a page, i.e., between blocks 416 and 426 in FIG. 4A. The typical shutdown revolutions and the typical run-in revolutions may be predetermined. The typical shutdown revolutions and the typical run-in revolutions may be stored in memory 126 of imaging device 102.

At block 474, controller 104 may then determine whether the total number of unproductive revolutions determined at block 472 (SRO unproductive revolutions) is greater than a predetermined threshold (SRO unproductive revolutions threshold). Upon a determination that the total number of unproductive revolutions determined at block 472 does not exceed the predetermined threshold, example method 400 may then proceed to block 440 where controller 104 may determine whether there is a resolution switch or a print process speed change needed for the next print job page.

At block 476, controller 104 may disable SRO function 132 upon a determination that the total number of unproductive revolutions determined at block 474 exceeds the predetermined threshold. Following performing the action at block 476, example method 400 may then proceed to block 440 where controller 104 determines whether a resolution switch or a print process speed change is needed for the next print job page.

In example methods 300 and 400, revolutions made by PC drum 164 are taken into consideration in identifying the presence of unproductive revolutions. However, it will be understood by those skilled in the art that another component in imaging device 102 may be considered for tracking the number of unproductive revolutions incurred. For example, revolutions made by fuser 154 may be considered in performing example methods 300 and 400.

It will be understood that the example applications described herein are illustrative and should not be considered limiting. It will be appreciated that the actions described and shown in the example flowcharts may be carried out or performed in any suitable order. It will also be appreciated that not all of the actions described in FIGS. 3, 4A, and 4B need to be performed in accordance with the example embodiments of the disclosure and/or additional actions may be performed in accordance with other example embodiments of the disclosure.

Many modifications and other example embodiments of the disclosure set forth herein will come to mind to one skilled in the art to which this disclosure pertains having the benefit of the teachings presented in the foregoing description and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of reducing churn in an imaging device, comprising:

determining whether a print setting of a page differs from a print setting of a previously printed page; and upon a positive determination:

identifying a number of unproductive revolutions made by a print engine of the imaging device while transitioning the imaging device to a print-ready mode;

determining whether the number of unproductive revolutions exceeds a predetermined threshold; and using a predetermined speed limit when printing the page upon the determination that the number of unproductive revolutions exceeds the predetermined threshold.

2. The method of claim 1, further comprising determining whether a page printed is beyond a preidentified roller in the imaging device, wherein the determining whether the print setting of the page differs from the print setting of the previously printed page is performed upon a determination that the page printed is beyond the preidentified roller.

3. The method of claim 1, wherein the identifying the number of unproductive revolutions includes calculating a value by adding a number of revolutions when transitioning the imaging device to the print-ready mode to a predetermined pick distance value and subtracting a predetermined gap distance value between two printed pages, and wherein the calculated value is compared to the predetermined threshold.

4. The method of claim 1, wherein the determining whether the print setting of a page differs from the print setting of the previously printed page is performed until no more pages to be printed remains.

5. The method of claim 1, further comprising:

determining whether a function in the imaging device is enabled;

upon a positive determination:

identifying a second number of unproductive revolutions made in the print engine while transitioning the imaging device to a print-ready mode; and determining whether the second number of unproductive revolutions has reached a second predetermined threshold, wherein the determining whether the print setting of the page differs from the print setting of the previously printed page is performed following the determining whether the number of unproductive revolutions has reached the second predetermined threshold.

6. The method of claim 5, further comprising disabling the function in the imaging device upon a positive determination that the number of unproductive revolutions has reached the predetermined threshold.

7. A method of reducing churn in an imaging device, comprising:

determining whether a function in the imaging device is enabled;

upon a positive determination:

identifying a number of unproductive revolutions made by a print engine of the imaging device while transitioning the imaging device to a print-ready mode;

determining whether the number of unproductive revolutions has reached a predetermined threshold; and disabling the function in the imaging device upon the determination that the number of unproductive revolutions has reached the predetermined threshold.

8. The method of claim 7, wherein the determining whether the function in the imaging device is enabled is performed upon a determination that a print j ob is received in the imaging device.

9. The method of claim 7, wherein the determining whether the function in the imaging device is enabled comprises an instruction to transition the print engine to the print-ready mode when a print job is received by the imaging device.

10. The method of claim 7, further comprising:

determining prior to printing a page of a print job whether a print setting of the page differs from a print setting of a previously printed page; and upon a positive determination:

identifying a second number of unproductive revolutions made by the print engine while transitioning the imaging device to the print-ready mode;

determining whether the second number of unproductive revolutions exceeds a second predetermined threshold; and using a predetermined speed limit when printing the page upon the determination that the second number of unproductive revolutions exceeds the second predetermined threshold.

11. The method of claim 10, wherein the determining whether the print setting of the page differs from the print setting of the previously printed page includes determining whether a resolution of the page differs from a resolution of the previously printed page.

12. The method of claim 10, wherein the determining whether the print setting of the page differs from the print setting of the previously printed page includes determining whether a print process speed for the page differs from a print process speed used for the previously printed page.

13. The method of claim 7, further comprising:

determining whether a page of a print job corresponds to a last page of the print job; and upon the determination that the page is the last page, determining whether a second function in the imaging device is enabled, wherein upon a determination that the second function in the imaging device is enabled, the imaging device:

tracks a third number of unproductive revolutions made in the print engine while transitioning the imaging device to the print-ready mode;

determines whether the third number of unproductive revolutions exceeds a third predetermined threshold; and disables the second function in the imaging device upon a determination that the third number of unproductive revolutions exceeds the third predetermined threshold, and wherein upon a determination that the second function in the imaging device is disabled, the imaging device powers down the print engine.

14. The method of claim 13, wherein the determining whether the second function in the imaging device is enabled includes determining whether to maintain the print engine in the print-ready mode over a predetermined period of time to wait for a new print job to be received.

15. An imaging device, comprising:

a controller having an associated memory for storing a plurality of instructions; and a print engine communicatively connected to the controller, wherein the plurality of instructions in the controller includes instructions to:

track a number of unproductive revolutions by the print engine while transitioning the imaging device to a print-ready mode;

determine whether the number of unproductive revolutions in the print engine has reached a predetermined threshold; and adjust one or more settings in the imaging device prior to picking a media sheet upon the determination that the number of unproductive revolutions has reached the predetermined threshold.

16. The imaging device of claim 15, wherein the plurality of instructions in the controller includes an instruction to track the number of unproductive revolutions upon a determination that one of a resolution change and a print process speed change has occurred prior to printing a page.

17. The imaging device of claim 15, wherein the plurality of instructions in the controller includes an instruction to track the number of unproductive revolutions upon a determination that a function for performing a print performance is enabled in the imaging device.

18. The imaging device of claim 15, wherein the instructions to adjust the one or more settings in the imaging device includes an instruction to disable an advanced start function in the imaging device.

19. The imaging device of claim 15, wherein the instruction to adjust the one or more settings in the imaging device includes an instruction to disable a smart run-out function in the imaging device.

20. The imaging device of claim 15, wherein the instruction to adjust the one or more settings in the imaging device includes an instruction to enable a predetermined process speed limit in the imaging device.

* * * * *